United States Patent [19]

Jeschke et al.

[11] Patent Number: 4,965,014

[45] Date of Patent: Oct. 23, 1990

[54] LIQUID NONIONIC SURFACTANT MIXTURES

[75] Inventors: Peter Jeschke, Neuss; Eva Kiewert, Duesseldorf; Claus Nieendick, Krefeld; Hans Nuesslein, Langenfeld; Peter Sandkuehler, Hilden, all of Fed. Rep. of Germany

[73] Assignee: Henkel Kommanditgesellschaft auf Aktien, Duesseldorf, Fed. Rep. of Germany

[21] Appl. No.: 361,672

[22] Filed: Jun. 1, 1989

Related U.S. Application Data

[63] Continuation of Ser. No. 137,117, Dec. 22, 1987, abandoned.

[30] Foreign Application Priority Data

Dec. 22, 1986 [DE] Fed. Rep. of Germany ..... 3643895

[51] Int. Cl.[5] ..... C11D 3/04; C11D 7/00; C11D 3/066; C11D 1/83

[52] U.S. Cl. ..... 252/174.22; 252/135; 252/174.21; 252/525; 252/540; 252/559

[58] Field of Search ..... 252/174.21, 174.22, 252/135, 525, 559, 540, DIG. 1

[56] References Cited

U.S. PATENT DOCUMENTS

| | | | |
|---|---|---|---|
| 2,174,761 | 10/1939 | Schuette et al. | 260/458 |
| 4,075,118 | 2/1978 | Gault et al. | 252/135 |
| 4,079,078 | 3/1978 | Collins | 252/545 |
| 4,280,919 | 7/1981 | Stoeckigt et al. | 252/135 |
| 4,375,565 | 3/1983 | Greif et al. | 568/622 |
| 4,608,189 | 8/1986 | Koch et al. | 252/174.22 |
| 4,624,803 | 11/1986 | Balger et al. | 252/527 |
| 4,666,615 | 5/1987 | Disch et al. | 252/121 |
| 4,668,423 | 5/1987 | Drozd et al. | 252/174.21 |
| 4,675,124 | 6/1987 | Seiter et al. | 252/174.22 |

FOREIGN PATENT DOCUMENTS

| | | |
|---|---|---|
| 2810703 | 9/1978 | Fed. Rep. of Germany . |
| 2724349 | 12/1978 | Fed. Rep. of Germany . |
| 2837504 | 3/1980 | Fed. Rep. of Germany . |
| 1601652 | 11/1981 | United Kingdom . |

*Primary Examiner*—Paul Lieberman
*Assistant Examiner*—Alexander Ghyka
*Attorney, Agent, or Firm*—Ernest G. Szoke; Wayne C. Jaeschke; Daniel S. Ortiz

[57] ABSTRACT

The invention relates to a liquid mixture of propylene oxide-ethylene oxide derivatives of alcohols corresponding to the following formula $$R—O—C_3H_5O_{1-2}—(C_2H_4O)_{6-8}—H$$

in which R is a linear alkyl or alkenyl radical which may be methyl-branched in the 2-position, and which has the following chain distribution: $C_8$=0 to 5%, $C_{9-10}$=75 to 90%, $C_{11-12}$=5 to 15%, $C_{13-14}$=4 to 10%, $C_{15-16}$=0 to 3%. By virtue of its physical and washing-active properties, the mixing is suitable as a readily biodegradable substitute for alkylphenol ethoxylates.

20 Claims, No Drawings

LIQUID NONIONIC SURFACTANT MIXTURES

This application is a continuation of application Ser. No. 07/137,117, filed Dec. 22, 1987 abandoned.

BACKGROUND OF THE INVENTION

1. Field of the Invention

This invention relates to nonionic surfactants which are mixtures of alcohols which have been polyalkoxylated, and detergent compositions containing these surfactants.

2. Statement of Related Art

The alkylphenol ethoxylates widely used today as nonionic surfactant components show considerably better low-temperature behavior (lower pour point and cold cloud point) than comparable ethoxylates based on linear fatty alcohols. Among the alkylphenol ethoxylates, the nonylphenol-10 E.O.-adduct (NP-10) is distinguished by such excellent performance properties that it constitutes not only a universally useable surfactant for detergents and cleaning preparations, but also an emulsifier for various technical applications. In addition, this surfactant has very good degreasing properties both on metals and on fabrics. By virtue of these favorable properties, NP-10 is today quantitatively by far the most important representative of the alkylphenol ethoxylates.

The disadvantage of the alkylphenol ethoxylates is their poor environmental compatibility, so that considerable efforts are being made to replace this basically very valuable surfactant component at least partly by components showing improved environmental compatibility. Alkoxylated fatty alcohols of natural and/or synthetic origin are an obvious choice in this regard. However, their use involves the following difficulty: ether alcohols of the type just mentioned only show the hydrophilic data required in practice (for example, cloud point in the range 50° to 60° C.) in forms in which the ether alcohols as such are solid at room temperature. This imposes a significant limitation on efforts to replace the alkylphenol adducts by adducts of primary fatty alcohols.

DESCRIPTION OF THE INVENTION

Other than in the operating examples, or where otherwise indicated, all numbers expressing quantities of ingredients or reaction conditions used herein are to be understood as modified in all instances by the term "about".

The present invention provides surfactant mixtures based on alkoxylated linear and/or branched primary alcohols, more especially corresponding linear fatty alcohols, which are still liquid at low temperatures, for example at temperatures of down to 5° C., and which are capable of developing high surfactant power. More particularly, the present invention provides a surfactant mixture which is equivalent to NP-10 in its important technological properties and which is based solely on environmentally compatible components.

Accordingly, the present invention relates to surfactant mixtures of high surfactant power which are liquid at room temperature and which are based on polyalkoxylated alcohols, comprising a linear ether alcohol and/or an ether alcohol methyl-branched in the 2-position corresponding to the following general formula $$R—O—(PO)_{1-2}—(EO)_{6-8}—H$$

in which PO is the residue of ring-opened propylene oxide and EO is the residue of ring-opened ethylene oxide, in which the alkyl or alkenyl radicals R have the following composition: $C_8$=0 to 5% by weight, $C_{9-10}$=75 to 90% by weight, $C_{11-12}$=5 to 15% by weight, $C_{13-14}$=4 to 10% by weight and $C_{15-16}$=0 to 3% by weight.

R preferably are linear alkyl radicals having the following composition: $C_8$=0 to 2% by weight, $C_{10}$=80 to 84% by weight, $C_{12}$=7 to 12% by weight, $C_{14}$=6 to 8% by weight and $C_{15-16}$=0 to 1% by weight.

The mixture according to the invention is prepared in known manner by alkoxylation of the alcohol mixture in two stages, propylene oxide being added in the first stage and ethylene oxide in the second stage. The starting alcohols used are, primarily, mixtures obtained from coconut fatty alcohols, from which the main fraction of $C_{12-16}$ alcohols has been separated off by distillation. Mixtures obtained from synthetic fatty alcohols, for example oxo alcohols, may also be used as starting materials. Alcohols such as these generally contain a proportion of alcohols methyl-branched in the 2-position. However, it is preferred to use the mixtures obtained from natural origin alcohols in which the alkyl radicals differ from one another by 2 carbon atoms.

As already known, the alkoxylation process may be carried out in the presence of acidic or alkaline catalysts. It is preferred to use alkaline catalysts, such as hydroxides or alcoholates of potassium or sodium, including NaOH, KOH, sodium methylate, sodium ethylate, potassium methylate and potassium ethylate. To obtain more rapid and more homogeneous distribution in the substrate, the hydroxides and alcoholates may be used in alcoholic solution, the solvent alcohol being removed by distillation before the alkoxylation. The catalyst is normally used in a quantity of from 0.5 to 5%, preferably 1 to 3%, based on starting material. The alkoxylation reaction may be carried out under normal pressure by introduction of the alkylene oxides into the alcohol mixture. However, it is preferably carried out in an autoclave under an elevated initial pressure, for example under an initial pressure of 2 to 10 bar, preferably 3 to 6 bar. As the reaction progresses, the pressure falls to normal pressure. The temperature of the alcohol to be alkoxylated is generally 80° to 200° C., especially 100° to 180° C. The alkoxylate may generally be directly used. If the small catalyst residues are a problem, they may be neutralized, by addition of organic acids, such as acetic acid or citric acid. However, carbon dioxide may also be introduced under pressure into the autoclave on completion of the alkoxylation reaction and the alkali carbonate precipitating removed by filtration.

Alkoxylated fatty alcohols in the production of which first propylene oxide and then ethylene oxide are added are known. However, they differ very considerably from the mixtures according to the invention in regard to the composition of the residue R. Thus, U.S. Pat. No. 2,174,761 describes products of which some contain considerably higher proportions of PO and which are derived from cetyl or dodecyl alcohol. These products show considerably higher solidification points and poorer biodegradability. German patent document No. 27 24 349 describes spray dried detergents containing nonionic surfactants of similar constitution in which the alkyl radicals preferably contain from 12 to 18 carbon atoms and do not comprise mixtures predominantly containing $C_{9-10}$ alkyl radicals. The same applies to the detergent granulates described in German patent document No. 28 37 504. Nonionic surfactants containing the PO and EO groups in a different sequence are described in German patent document No. 28 10 703. A comparison test in which a mixed alcohol containing 43% $C_{12}$ alkyl radicals and 57% $C_{13}$ alkyl radicals (78% linear, 22% methyl-branched) and reacted with 4 mols PO and 15 mols EO was investigated, reveals a comparatively high solidification point and a less favorable washing result, so that it had not been expected that the mixtures according to the invention would offer significant advantages in this regard. Finally, U.S. Pat. No. 4,608,189 (and corresponding German patent document No. 32 32 616) describes liquid detergents containing mixtures of nonionic surfactants of comparable molecular structure. However, these alkoxylates are mainly derived from $C_{12-18}$ alcohols or from mixtures of cetyl, oleyl and stearyl alcohol mixtures. Surfactant mixtures having the composition according to the invention are neither disclosed nor suggested.

One particular advantage of the nonionic surfactant mixtures of the invention, particularly over alkoxylated alkylphenols, lies in their very high biological degradability of more than 96%. So far as performance properties are concerned, nonionic surfactant mixtures according to the invention are equivalent to the best alkylphenol ethoxylates. This applies both to the compounds alone and to mixtures thereof with other auxiliaries and additives of the type normally used in detergents and cleaning preparations, emulsifiers and dispersants.

In another embodiment, therefore, the present invention relates to the replacement of nonylphenol-9 or 10 EO by the surfactant mixture defined in accordance with the invention in known solid and liquid preparations, more especially detergents, wetting agents and dispersants.

In still another embodiment of the invention, the liquid nonionic surfactants may also be combined with other readily biodegradable nonionic compounds. With combinations such as these, it is possible to increase detergency even further without any adverse affects upon the other positive properties. Suitable other nonionics are ethoxylates containing an average 1 to 4 and preferably 2 to 3 EO groups derived from primary alcohols or preferably alkylamines containing from 10 to 18 and more especially from 10 to 14 carbon atoms. The mixing weight ratio of the inventive mixture with these other nonionics may be 1:0.1–2. In addition, where they are used in detergents and cleaning preparations, the inventive mixtures may be combined with known anionic, nonionic, ampholytic, zwitterionic and cationic surfactants (other than alkylphenol ethoxylates), builder salts, sequestrants, bleaches, redeposition inhibitors, softening agents, foam inhibitors and other active substances of the type normally used in detergents and cleaning preparations. The blended detergents may be present in solid or granular form or in liquid form. Of particular interest in the present case are liquid fabric and dishwashing detergents and cleaning preparations, for which the alkoxylates according to the invention are particularly favorable by virtue of their low cloud points and their favorable dissolving properties.

I. Solid detergent compositions according to this invention may have the following composition (in % by weight anhydrous substance based upon the composition total weight):

(a) 0.5 to 25% and preferably 1 to 20% of a nonionic surfactant mixture according to the invention, (b) 0 to 25% and preferably 2 to 20% of at least one anionic surfactant of the alkali soap sulfonate type, more especially $C_{9-13}$ alkylbenzenesulfonates, alphasulfofatty acid salts, alpha-sulfofatty acid alkyl ester salts and alkane sulfonates, in each case containing from 12 to 18 carbon atoms in the aliphatic moiety, (c) 0 to 10% of at least one nonionic $C_{10-18}$ (preferably $C_{10-14}$) alcohol or alkylamine ethoxylate containing 1 to 4 (preferably 2 to 3) EO (ethoxylate) groups, (d) 10 to 70% and preferably 20 to 50% of at least one builder salt which is selected from phosphates, polyphosphates, sodium carbonates, sodium silicates, sodium nitrilotriacetate and finely divided NaA type zeolites, (e) 0.1 to 5% of at least one complexing agent which is a sodium polyphosphonic acid sodium salt of a homo- or copolymeric polymer carboxylic acid, (more especially hydroxyethane diphosphonate, ethylenediamine tetramethylene phosphonate and/or acrylic acid-maleic acid copolymers), (f) 0 to 30% and preferably 5 to 20% of at least one peroxy compound or a combination thereof with an activator, more especially sodium perborate monohydrate or tetrahydrate, and/or tetraacetyl ethylenediamine, (g) 0 to 10% of at least one other standard detergent constituent selected from redeposition inhibitors, enzymes, optical brighteners, dyes and perfumes, (h) 0 to 30% of at least one neutral salt, such as sodium sulfate.

II. Liquid detergent compositions according to this invention may have the following composition:

(a) 5 to 30% and preferably to 25% of a nonionic surfactant mixture according to the invention, (b) 0 to 20% and preferably 2 to 15% of the anionic surfactants mentioned above in connection with the solid detergent compositions, (c) 0 to 10% of the nonionic alcohol ethoxylates mentioned above in connection with the solid detergent compositions, (d) 0.1 to 4% and preferably 0.2 to 2% of the polyphosphonate complexing agents mentioned above in connection with the solid detergent compositions, (e) 0 to 2% of at least one compatible known optical brightener, (f) organic solvents, hydrotropes, and water, q.s. to 100%, all percentages being by weight.

EXAMPLES

The properties of nonylphenol-10 EO are compared with those of a surfactant mixture according to the invention ("product A"). This "product A" has the following composition:

average number of PO groups 1.2 average number of EO groups 6.4

$C_8$=1%, $C_{10}$=82%, $C_{12}$=10%, $C_{14}$=7%, $C_{15-16}$=less than 0.1% (alkyl groups linear, saturated, primary OH group).

The comparison of the product properties was conducted according to the following criteria:

Cold cloud point [according to DIN (German Industrial Norm) 51 583]
Pour point (DIN 51 583)
Immersion wetting power (DIN 53 901)
Determination of surface tension (DIN 53 914)
Cloud temperature (1% in deionized water) (DIN 53 917)

TABLE 1

| Parameter | NP-10 | Product A according to the invention |
|---|---|---|
| Cold cloud point | 8–10° C. | 9–10° C. |
| Pour point | 6–8° C. | 3° C. |
| Immersion wetting power | 18 secs. | 17 secs. |
| Surface tension | 31 mN/m | 28 mN/m |
| Cloud temperature | 60–65° C. | 54–55° C. |
| 1% solution in water | pH 7 | pH 7 |

Determination of detergency

The detergent formulation used had the following composition in which 4% nonylphenol+10 EO (NP-10) is present in the comparison and is replaced by product A in the invention examples. The ethoxylated $C_{12-14}$ amine+2 EO was a product prepared from coconut fatty acids.

TABLE 2

| Composition | Examples 1 | Examples 2 | Comparison |
|---|---|---|---|
| Product A | 4.0 | 2 | — |
| $C_{12-14}$ amine + 2 EO | — | 2 | — |
| Nonylphenol + 10 EO | — | — | 4.0 |
| Na n-dodecyl benzenesulfonate | 15.0 | 15.0 | 15.0 |
| Na soap (tallow fatty acid) | 2.5 | 2.5 | 2.5 |
| Zeolite NaA | 10.0 | 10.0 | 10.0 |
| Sodium carbonate | 10.0 | 10.0 | 10.0 |
| Na silicate ($Na_2O:SiO_2$ = 1:3.3) | 3.0 | 3.0 | 3.0 |
| Acrylic acid-maleic acid copolymer | 2.0 | 2.0 | 2.0 |
| Cellulose ether | 1.2 | 1.2 | 1.2 |
| Na sulfate | 46.3 | 46.3 | 46.3 |
| Perfume, water q.s. to 100% | balance | balance | balance |

Test conditions

Washing machine with horizontally arranged drum (Miele U 433): one-wash program; 60° C.; concentration 5 g/l; water hardness 16° Gh; 3×rinsing and spinning; fabric samples of cotton (C), polyester (PE) and polyester/cotton blend (PE/C), soiled in each case with a dust-sebum combination; 0.3 kg test fabrics and 3 kg clean "filling" fabrics; photometric evaluation.

TABLE 3

| Results in percentage spectrophotographic reflectance | | | |
|---|---|---|---|
| Product tested | C | PE | PE/C |
| Example 1 | 50.4 | 54.8 | 41.4 |
| Example 2 | 51.7 | 55.3 | 43.4 |
| Comparison | 50.3 | 55.0 | 41.6 |

In a second series of tests, strands of wool soiled with dust and sebum were washed at 30° C. in a detergent of the following composition (detergent concentration in 1.8 g/l):

TABLE 4

| Composition/Result | Examples 3 | Examples 4 | Comparison |
|---|---|---|---|
| Product A | 3 | 1.5 | — |
| $C_{12-14}$ amine + 2 EO | — | 1.5 | — |
| Nonylphenol + 10 EO | — | — | 3 |

TABLE 4-continued

| Composition/Result | Examples 3 | Examples 4 | Comparison |
|---|---|---|---|
| Sodium sulfate, water q.s. to 100% | balance | balance | balance |
| Percentage spectrophotographic reflectance | 39.9 | 42.2 | 40.0 |

So far as their detergency is concerned, the mixtures according to the invention are capable of replacing the ethoxylated nonylphenol without any significant loss of effect. The combination according to Examples 2 and 4 are superior to the comparison product, and the combinations according examples 1 and 3 are comparable to the comparison product in cleaning ability.

Biological degradability

In the modified OECD screening test, product A according to the invention reached a carbon degradation of more than 70% and, accordingly, counts as readily biodegradable. The prior art compound of nonylphenol+9 EO and 10 EO does not reach this value. According to the Federal Republic of Germany criteria of the "Legislation of the Degradability of Anionic and Nonionic Substances in Detergents and Cleaning Preparations" (Verordnung ueber die Abbaubarkeit anionischer und nichtionischer Stoffe in Wasch- and Reinigungsmitteln) of Jan. 30, 1977, degradibility exceeded 80% (observed value over 96%)".

EXAMPLES 5 to 7

The following tests show that even small additions of the product according to the invention, employed as an additive to otherwise known detergent formulations, produce a distinct increase in detergency and are superior in this regard to known detergency enhancers (alkoxylated alkylamines).

The detergent formulations were tested in the machine used in Example I against the following series of soils and substrates:

A I: dust/sebum on cotton (standard fabric of the Wascherei-Forschungsinstitut (Laundry Research institute), Krefeld, F. R. Germany)
A II: dust/sebum on refined cotton
A III: dust/sebum on 1:1 blend of refined cotton and polyester
A IV: dust/sebum on polyester: dust/sebum on wool
A VI: lipstick on fabric A III Washing conditions (one-wash cycle without prewash)

Example 5: normal wash program, 60° C., liquor ratio (kg washing per liter water)=1:5.6, dosage 4.4 g/l Example 6: easy-case wash program, 40° C., liquor ratio 1:25, dosage 4.4 g/l 7: delicates wash program, 40° C., liquor ratio 1:3.5, dosage 4.4 g/l "NP10" which is nonylphenol, and "CA-2 EO" which is coconut amine+2 EO (coconut alkyl=2% $C_{10}$, 56% $C_{12}$, 22% $C_{14}$, 9% $C_{16}$, 11% $C_{18}$), were used in the comparison tests (index a, b). TA-5/10 EO is a 1:1 mixture of $C_{16-18}$ tallow alcohol+5 EO and 10 EO, $C_{12}$-ABS is Na dodecyl benzenesulfonate ($C_{11-13}$ alkyl), the soaps are sodium soaps, STP is sodium tripolyphosphate, Aa Ma Cop is a 2:1 acrylic acid-maleic acid-copolymer Na salt (MW=70,000).

The results are shown in Table 5. They reflect the improved detergency of the products in relation to NP 10 and the increased enhancement of detergency in relation to CA-2 EO.

TABLE 5

| Constituent | Example 5 | Example 5a | Example 6 | Example 6a | Example 6b | Example 7 | Example 7a |
|---|---|---|---|---|---|---|---|
| Product A | 1 | — | 2 | — | — | 1 | — |
| CA-2 EO | — | — | — | — | 2 | — | 1 |
| NP10 | — | — | — | 2 | — | — | — |
| TA 5/10 EO | 2.5 | | | 2 | | 2.5 | |
| $C_{12}$-ABS | 7 | | | 18 | | 7 | |
| Coconut soap | — | | | 5 | | — | |
| Tallow soap | 1 | | | — | | 1 | |
| Zeolite NaA | — | | | — | | 20 | |
| Soda | — | | | — | | 6 | |
| STP | 18 | | | 20 | | — | |
| $Na_2O:SiO_2$ 1:3.3 | 3.5 | | | — | | 3.5 | |
| $Na_2O:SiO_2$ 1:2 | — | | | 9 | | — | |
| Cellulose ether | 0.8 | | | — | | 0.8 | |
| Na sulfate | 55 | | | 33 | | 43 | |
| Water q.s. to 100% | balance | | | balance | | balance | |
| | percentage spectrophotographic reflectance | | | | | | |
| Soil/Substrate | 5 | 5a | 6 | 6a | 6b | 7 | 7a |
| A I | 71.7 | 70.2 | 45.5 | 45.3 | 43.7 | 52.7 | 47.3 |
| A II | 47.7 | 45.8 | 41.5 | 39.3 | 37.4 | 40.1 | 36.3 |
| A III | 55.3 | 52.5 | 41.6 | 41.4 | 41.4 | 41.0 | 35.8 |
| A IV | 57.8 | 54.7 | 55.0 | 53.6 | 54.2 | 47.6 | 43.0 |
| A V | — | — | 52.5 | 52.3 | 52.2 | — | — |
| A VI | — | — | — | — | — | 26.8 | 25.4 |

EXAMPLES 8 and 9

All-purpose cleaners of the following composition were prepared and tested in a typical concentration in use for products of this category to determine their cleaning effect.

TABLE 6

| Constituent | Example (% by weight) 8 | 8a | 9 | 9a |
|---|---|---|---|---|
| Product A | 8 | — | 2 | — |
| NP10 | — | 8 | — | 2 |
| Fatty alcohol ($C_{12-14}$)-2 EO sulfate | 1 | 1 | — | — |
| Fatty alcohol ($C_{12-14}$)-sulfate | — | — | 8 | 8 |
| Octyl sulfate | — | — | 2 | 2 |
| Trisodium citrate | 3 | 3 | — | — |
| Sodium gluconate | — | — | 2 | 2 |
| Sodium bicarbonate | — | — | 1 | 1 |
| Water, perfume, dye (q.s. to 100%) | ... | ... | ... | ... |

Test conditions

Cleaning power was determined in accordance with the quality standards of the F. R. Germany Industrieverband Putz- and Pflegemittel, published in Seigen, Oele, Fette, Wachse. 108, no. 16. page 527 (1982).

To test the cleaning effect, the cleaning preparation to be tested was applied in the form of a 1% aqueous solution to an artificially soiled PVC plastic surface. A mixture of soot, machine oil, triglyceride of saturated fatty acids and low-boiling aliphatic hydrocarbon was used as the artificial soil. The test area of 26×28 cm was uniformly coated with 2 g of the artificial soil using a surface spreader.

A plastic sponge was soaked with 20 ml of the cleaning solution to be tested and moved by machine over the test surface. After 6 wiping movements, the cleaned test surface was held under running water and the loose soil removed. The cleaning effect, i.e. the whiteness of the plastic surface thus cleaned, was measured using a Dr. B. Lange LF 90 photoelectric colorimeter. The clean white plastic surface was used as the whiteness standard.

Since, in the measurement of the clean surface, the colorimeter was adjusted to 100% and the soiled surface gave a reading of 0, the values in the case of the cleaned plastic surfaces could be equated with the percentage cleaning power (% CP).

TABLE 7

| Results | % Cleaning power |
|---|---|
| Example 8 | 48 |
| Comparison 8 a | 50 |
| Example 9 | 52 |
| Comparison 9 a | 51 |

The results show that it is only in formulations of high surfactant content (Ex. 8, 8*a*) is NP10 slightly superior to the mixtures according to the invention but, when sparingly used, (Ex. 9, 9*a*) the cleaning effect of the inventive surfactants is slightly better.

EXAMPLES 10 and 11

Liquid scouring preparations having the composition indicated below were prepared and tested for their cleaning effect. The test procedure was identical with the procedure used to test all-purpose cleaners. Since liquid scouring preparations are used, a difficult test soil predominantly containing pigments was used in addition to the predominantly fatty test soil already mentioned. This difficult test soil consisted of soot, kaolin, calcium carbonate, petroleum jelly and a low-boiling aliphatic hydrocarbon.

TABLE 8

| Composition | Example 10 | Example 11 | Comparison |
|---|---|---|---|
| Product A | 4 | 2 | — |
| Fatty alcohol ($C_{12}$-$C_{14}$) + 4 EO | — | 2 | — |
| NP10 | — | — | 4 |
| Polyacrylate (Na salt) | 0.5 | 0.5 | 0.5 |
| Diethanolamine | 1.0 | 1.0 | 1.0 |
| Marble powder | 45.0 | 45.0 | 45.0 |
| Water, perfume, q.s. to 100% | | | |
| Contaminant | % Cleaning power | | |
| Fatty soil | 88 | 87 | 90 |
| Pigment soil | 86 | 82 | 77 |

The results show that the mixture according to the invention are almost equivalent to the comparison product against fatty soil and are superior against pigment soil.

We claim:

1. A liquid nonionic surfactant mixture comprising linear alcohols and/or ether alcohols methyl-branched in the 2 position, of the formula $$R—O—(PO)_{1-2}—(EO)_{6-8}—H$$

wherein:

P0 is the residue of a ring-opened propylene oxide;

EO is the residue of a ring-opened ethylene oxide; and

R is a mixture of alkyl or alkenyl moities of about the following distribution:

| Carbon atoms | weight percent |
|---|---|
| $C_8$ | 0–5 |
| $C_{9-10}$ | 75–90 |
| $C_{11-12}$ | 5–15 |
| $C_{13-14}$ | 4–10 |
| $C_{15-16}$ | 0–3 |
| Total | 100% |

2. The mixture of claim 1 wherein R is a mixture of linear alkyl moieties of about the following distribution:

| Carbon atoms | weight percent |
|---|---|
| $C_8$ | 0–2 |
| $C_{10}$ | 80–84 |
| $C_{12}$ | 7–12 |
| $C_{14}$ | 6–8 |
| $C_{15-16}$ | 0–1 |
| Total | 100% |

3. The mixture of claim 1 wherein R is a mixture of linear alkyl moieties of about the following distribution:

| Carbon atoms | weight percent |
|---|---|
| $C_8$ | 1 |
| $C_{10}$ | 82 |
| $C_{12}$ | 10 |
| $C_{14}$ | 7 |
| $C_{15-16}$ | $<0.1$ |
| Total | 100% |

4. A solid detergent composition free from any alkoxylated alkylphenols comprising:

(a) 0.5 to 25% of a surfactant mixture of claim 1;
(b) 0 to 25% of at least one alkali soap sulfonate anionic surfactant;
(c) 0 to 10% of at least one nonionic $C_{10-18}$ alcohol or alkylamine ethoxylate containing 1 to 4 ethoxylate groups;
(d) 10 to 70% of at least one builder salt which is selected from phosphate, polyphosphates, sodium carbonates, sodium silicates, sodium nitrilotriacetate, and finely divided NaA type zeolites;
(e) 0.1 to 5% of at least one complexing agent which is a polyphosphonic acid sodium salt, or a homo- or copolymeric polymer carboxylic acid;
(f) 0 to 30% of at least one peroxy compound or a combination thereof with an activator;
(g) 0 to 10% of at least one other standard detergent constituent selected from redeposition inhibitors, enzymes, optical brighteners, dyes, and perfumes; and
(h) 0 to 30% of at least one neutral salt;

all percentages being by weight of anhydrous substance, based upon the composition total weight.

5. A solid detergent composition free from any alkoxylated alkylphenols comprising:

(a) 0.5 to 25% of a surfactant mixture of claim 2;
(b) 0 to 25% of at least one alkali soap sulfonate anionic surfactant;
(c) 0 to 10% of at least one nonionic $C_{10-18}$ alcohol or alkylamine ethoxylate containing 1 to 4 ethoxylate groups;
(d) 10 to 70% of at least one builder salt which is selected from phosphate, polyphosphates, sodium carbonates, sodium silicates, sodium nitrilotriacetate, and finely divided NaA type zeolites;
(e) 0.1 to 5% of at least one complexing agent which is a polyphosphonic acid sodium salt, or a homo- or copolymeric polymer carboxylic acid;
(f) 0 to 30% of at least one peroxy compound or a combination thereof with an activator;
(g) 0 to 10% of at least one other standard detergent constituent selected from redeposition inhibitors, enzymes, optical brighteners, dyes, and perfumes; and
(h) 0 to 30% of at least one neutral salt;

all percentages being by weight of anhydrous substance, based upon the composition total weight.

6. A solid detergent composition free from any alkoxylated alkylphenols comprising:

(a) 0.5 to 25% of a surfactant mixture of claim 3;
(b) 0 to 25% of at least one alkali soap sulfonate anionic surfactant;
(c) 0 to 10% of at least one nonionic $C_{10-18}$ alcohol or alkylamine ethoxylate containing 1 to 4 ethoxylate groups;
(d) 10 to 70% of at least one builder salt which is selected from phosphate, polyphosphates, sodium carbonates, sodium silicates, sodium nitrilotriacetate, and finely divided NaA type zeolites;
(e) 0.1 to 5% of at least one complexing agent which is a polyphosphonic acid sodium salt, or a homo- or copolymeric polymer carboxylic acid;
(f) 0 to 30% of at least one peroxy compound or a combination thereof with an activator;
(g) 0 to 10% of at least one other standard detergent constituent selected from redeposition inhibitors, enzymes, optical brighteners, dyes, and perfumes; and
(h) 0 to 30% of at least one neutral salt;

all percentages being by weight of anhydrous substance, based upon the composition total weight.

7. The composition of claim 4 wherein the ingredients are present in:

(a) 1 to 20%;
(b) 2 to 20%;
(c) 0 to 10%;
(d) 20 to 50%;
(e) 0.1 to 5%;
(f) 5 to 20%;
(g) 0 to 10%; and
(h) to 30%.

8. The composition of claim 4 wherein the ingredients comprise:

(b) $C_{9-13}$ alkylbenzenesulfonates, alpha-sulfofatty acid salts, alpha-sulfofatty acid alkyl ester salts, and/or alkane sulfonates, each containing 12 to 18 carbon atoms in its aliphatic moiety;
(c) $C_{10-14}$ alkylamine ethoxylate containing 2 to 3 ethoxylate groups;
(e) hydrooxyethane diphosphonate, ethyenediamine tetramethylene phosphonate, and/or acrylic acid-maleic acid copolymers;
(f) sodium perborate monohydrate, sodium perborate tetrahydrate, and/or tetraacetyl ethylenediamine; and
(h) sodium sulfate.

9. The composition of claim 7 wherein the ingredients comprise:

(b) $C_{9-13}$ alkylbenzenesulfonates, alpha-sulfofatty acid salts, alpha-sulfofatty acid alkyl ester salts, and/or alkane sulfonates, each containing 12 to 18 carbon atoms in its aliphatic moiety;

(c) $C_{10-14}$ alkylamine ethoxylate containing 2 to 3 ethoxylate groups;

(e) hydrooxyethane diphosphonate, ethylenediamine tetramethylene phosphonate, and/or acrylic acid-maleic acid copolymers;

(f) sodium perborate monohydrate, sodium perborate tetrahydrate, and/or tetraacetyl ethylenediamine; and (h) sodium sulfate.

10. A liquid detergent composition free from any alkoxylated phenols comprising:

(a) 5 to 30% of a surfactant mixture according to claim 1;

(b) 0 to 20% of at least one alkali soap sulfonate anionic surfactant;

(c) 0 to 10% of at least one nonionic $C_{10-18}$ alcohol or alkylamine ethoxylate containing 1 to 4 ethoxylate groups;

(d) 0.1 to 4% of at least one complexing agent which is a polyphosphonic acid sodium salt;

(e) 0.2% of at least one compatible optical brightener; and (f) organic solvents, hydrotropes, and water q.s. to 100%;

all percentages being by weight.

11. A liquid detergent composition free from any alkoxylated phenols comprising:

(a) 5 to 30% of a surfactant mixture according to claim 2;

(b) 0 to 20% of at least one alkali soap sulfonate anionic surfactant;

(c) 0 to 10% of at least one nonionic $C_{10-18}$ alcohol or alkylamine ethoxylate containing 1 to 4 ethoxylate groups;

(d) 0.1 to 4% of at least one complexing agent which is a polyphosphonic acid sodium salt;

(e) 0.2% of at least one compatible optical brightener; and (f) organic solvents, hydrotropes, and water q.s. to 100%;

all percentages being by weight.

12. A liquid detergent composition free from any alkoxylated phenols comprising:

(a) 5 to 30% of a surfactant mixture according to claim 3;

(b) 0 to 20% of at least one alkali soap sulfonate anionic surfactant;

(c) 0 to 10% of at least one nonionic $C_{10-18}$ alcohol or alkylamine ethoxylate containing 1 to 4 ethoxylate groups;

(d) 0.1 to 4% of at least one complexing agent which is a polyphosphonic acid sodium salt;

(e) 0.2% of at least one compatible optical brightener; and (f) organic solvents, hydrotropes, and water q.s. to 100%;

all percentages being by weight.

13. The composition of claim 10 wherein the ingredients are present in:

(a) 8 to 25%;

(b) 2 to 15%;

(c) 0 to 10%;

(d) 0.2 to 2%; and (e) 0 to 2%.

14. The composition of claim 10 wherein the ingredients comprise:

(b) $C_{9-13}$ alkylbenzenesulfonate, alpha-sulfofatty acid salts, alpha-sulfofatty acid alkyl ester salts, and/or alkane sulfonates, each containing 12 to 18 carbon atoms in its aliphatic moiety;

(c) $C_{10-14}$ alkylamine ethoxylate containing 2 to 3 ethoxylate groups; and (e) hydroxyethane diphosphonates, ethylenediamine tetramethylene phosphonate, and/or acrylic acid-maleic acid copolymers.

15. The composition of claim 13 wherein the ingredients comprise:

(b) $C_{9-13}$ alkylbenzenesulfonate, alpha-sulfofatty acid salts, alpha-sulfofatty acid alkyl ester salts, and/or alkane sulfonates, each containing 12 to 18 carbon atoms in its aliphatic moiety;

(c) $C_{10-14}$ alkylamine ethoxylate containing 2 to 3 ethoxylate groups; and (e) hydroxyethane diphosphonates, ethylenediamine tetramethylene phosphonate, and/or acrylic acid-maleic acid copolymers.

16. A substitute for alkoxylated alkylphenol surfactants in detergent and cleaning preparations and as an emulsifier or degreaser, consisting essentially of the surfactant of claim 1.

17. A substitute for alkoxylated alkylphenol surfactants in detergent and cleaning preparations and as an emulsifier or degreaser, consisting essentially of a combination of the surfactant mixture of claim 1 in a 1:0.1–2 weight ratio with at least one nonionic compound which is $C_{10-18}$ alcohol or alkylamine ethoxylate containing 1 to 4 ethoxylate groups.

18. The substitute of claim 17 wherein said nonionic compound is a $C_{10-14}$ alkylamine containing 2 to 3 ethoxylated groups.

19. A substitute for alkoxylated alkylphenol surfactants in detergent and cleaning preparations and as an emulsifier or degreaser, consisting essentially of a combination of the surfactant mixture of claim 2 in a 1:0.1–2 weight ratio with at least one nonionic compound which a $C_{10-18}$ alcohol or alkylamine ethoxylate containing 1 to 4 ethoxylate groups.

20. The substitute of claim 19 wherein said nonionic compound is a $C_{10-14}$ alkylamine containing 2 to 3 ethoxylated groups.

* * * * *